United States Patent [19]

Escaravage

[11] Patent Number: 4,554,808

[45] Date of Patent: Nov. 26, 1985

[54] EXTERIOR CONTROL FOR A VEHICLE DOOR PROVIDED WITH AN ELECTRIC LATCH

[75] Inventor: Gérard Escaravage, Valentigney, France

[73] Assignee: Aciers et Outillage Peugeot, Audincourt, France

[21] Appl. No.: 513,494

[22] Filed: Jul. 13, 1983

[30] Foreign Application Priority Data

Jul. 29, 1982 [FR] France ..... 82 13276

[51] Int. Cl.[4] ..... E05B 47/00

[52] U.S. Cl. ..... 70/279; 70/DIG. 30; 292/201

[58] Field of Search ..... 70/279, 283, 208–211, 70/277, 280–282, 271, DIG. 30; 292/144, 201, DIG. 31

[56] References Cited

U.S. PATENT DOCUMENTS 1,965,482 7/1934 Walker ..... 292/144
2,212,251 8/1940 Seelinger ..... 70/283
2,271,966 2/1942 Baribault ..... 292/144 X

FOREIGN PATENT DOCUMENTS 2745711 4/1979 Fed. Rep. of Germany .
649708 12/1928 France ..... 292/201

*Primary Examiner*—Kenneth J. Dorner
*Assistant Examiner*—Lloyd A. Gall
*Attorney, Agent, or Firm*—Sughrue, Mion, Zinn, Macpeak and Seas

[57] ABSTRACT

This control comprises a pivotable actuating lever 6 whose ends forms a lug 20 for actuating the electric circuit of the latch and a heel 18 cooperative with a linkage for mechanically controlling the latch. A barrel 14 actuated by a key carries a locking cam 32 which, on one hand, actuates a bistable relay of the general electric supply circuit, and, on the other hand, forms an abutment 34 for stopping the pivoting of the lever 6. This cam may be shifted by means of the key so as to retract the abutment 34 and enable the lever to pivot until the linkage is brought into action for mechanically opening the latch.

6 Claims, 6 Drawing Figures

FIG.1
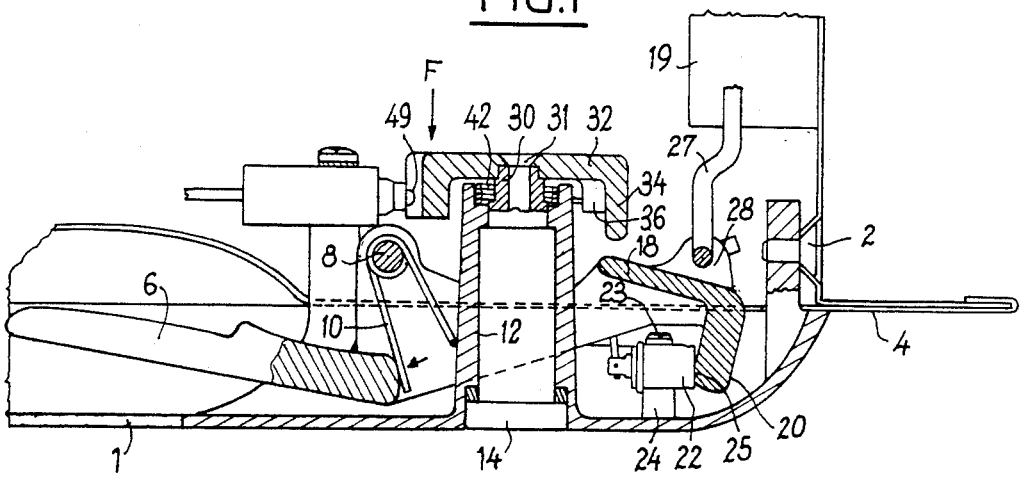
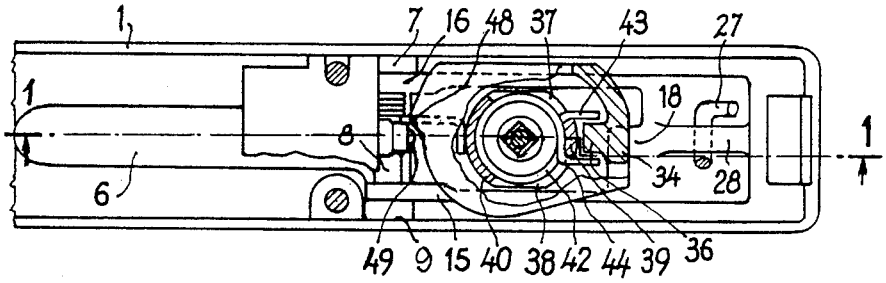
FIG.2
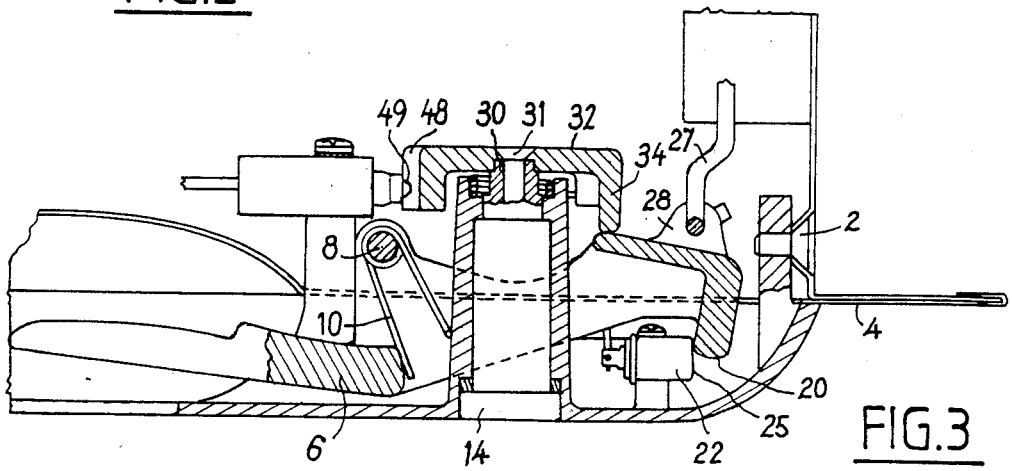
FIG.3

EXTERIOR CONTROL FOR A VEHICLE DOOR PROVIDED WITH AN ELECTRIC LATCH

Electric latches, such as those disclosed in the French patent applications filed by the Applicant on Oct. 18, 1978, under No. 78 29 650, Dec. 5, 1978, under the No. 78 36 231, Sept. 14, 1979, under the No. 79 27 580, Dec. 22, 1981, under the No. 81 23 916, and June 2, 1982, under the Nos. 82 09 598 and 82 09 599, permit the easy opening with a reduced effort of vehicle doors and are consequently likely to be used to an increasing extent.

The exterior control of these latches generally comprises a resiliently returned movable actuating element which actuates the electric circuit controlling the latch and opens it, and a barrel actuated by a key and connected to a locking mechanism which prevents this opening. The latch can only be opened in its closed position by means of the electric control circuit. Consequently, if this circuit breaks down, the latch is locked and the door can no longer be opened.

An object of the present invention is to overcome this drawback and to provide an exterior control which permits, if necessary, a mechanical opening of the latch while retaining the advantages of electric latches.

The invention therefore provides an exterior control of the aforementioned type in which the inner end of the actuating element is curved and forms, on one hand, a lug actuating the electric control circuit of the latch and, on the other hand, a heel cooperating with a linkage controlling the mechanical opening of the latch, while the barrel carries a locking cam provided with an abutment stopping the pivoting of the lever which is moved away from the path of the heel by rotation of the barrel so as to enable the lever to open the latch. Thus, according to the extent of the pivoting allowed thereto, the actuating lever brings about the normal electric opening or a safety mechanical opening of the latch. As it is moreover the rotation of the key and of the lock barrel which determines the extent of this pivoting, the opening is always possible.

According to another feature, the locking cam has a boss controlling the actuation of a bistable relay locking the latch.

Thus, the key actuating the barrel locks or unlocks the latch both in normal operation and in safety operation. Further, in any case it is rotated in the same direction, which considerably simplifies the operation.

The ensuing description of one embodiment, given merely by way of a non-limiting example and shown in the accompanying drawings, will show the advantages and features of the invention. In the drawings:

FIG. 1 is a horizontal sectional view of an exterior control according to the invention;

FIG. 2 is a view of this device in the direction of arrow F, with a part cut away;

FIG. 3 is a view similar to FIG. 1 of the control in the position for opening the latch;

Figure 4:
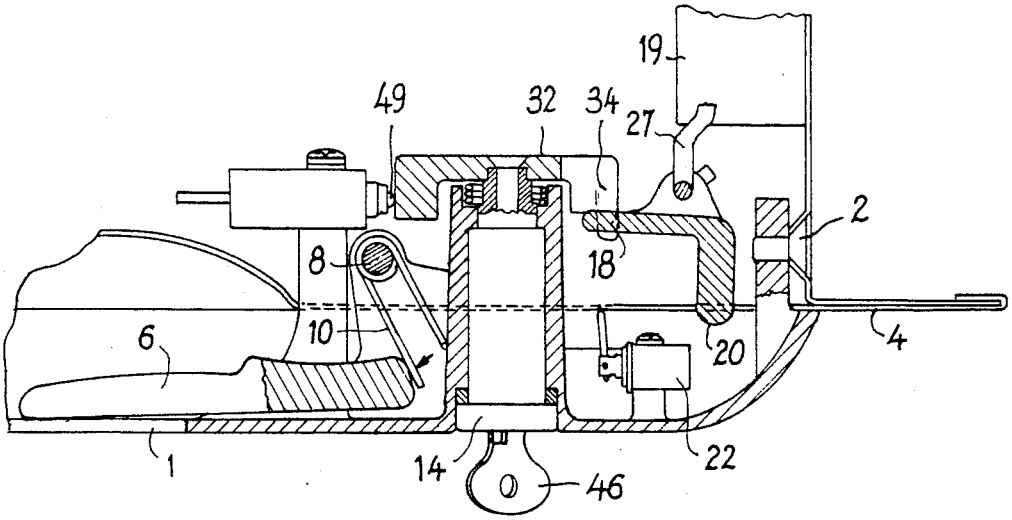
FIG. 4 is a view similar to FIG. 2 showing the position of the locking cam when the key is operative.

The exterior control shown in the drawings comprises a case 1 fixed in the conventional manner, for example by the screws 2, to the wall 4 of the door of the vehicle. The case 1 contains an actuating lever 6 which is mounted to pivot about a pin 8 carried by two ears, respectively 7 and 9, rigid with the wall of the case 1. A spring 10 wound around the pin 8 and bearing, on one hand, against the lever 6, and, on the other hand, against the case 1, biases the lever 6 to its position of rest.

Preferably, the spring 10 bears against a boss of the case which constitutes a sleeve 12 for housing a lock barrel or cylinder 14.

As shown in FIG. 2, the lever 6 is divided into two arms, respectively 15 and 16, each of which extends on one side of the sleeve 12 and which are interconnected by a curved portion which forms, on one hand, a heel 18 and, on the other hand, a lug 20 for actuating a switching means comprising a switch 22 which is a component part of an electric control circuit mounted in housing 19 of the latch. The switch 22 is fixed, for example by means 23, on bosses 24 of the case 1. It is capped by a flexible fluid-tight covering 25 and its rear part carries the electric connections which are embedded in a resin or the like, so as to ensure fluid-tightness.

When the lug 20 depresses the flexible covering 25 in the position shown in FIG. 1, it moves the movable part of the switch away so that the switch is opened and the electromagnetic means controlling the latch is not supplied with power. With the latch closed, if a pressure is exerted on the lever 6 so as to pivot it to the position shown in FIG. 3 against the action of the spring 10, the lug 20 releases the movable part of the switch 22 which closes the contact and enables the latch control electric shifting means to be supplied with power. The latch opens.

The heel 18 cooperates with a linkage 27 which is connected to an internal mechanism of the latch so as to control the latter. The linkage 27, in the illustrated embodiment, is mounted in an ear 28 of the heel 18. It has in this case a lost-motion travel corresponding to the displacement of the lug 20 and the heel 18 for controlling the switch 22, so that it does not come into action during the normal displacement of the lever for actuating the switch 22.

The opening of the door can however be prevented by means of a key which cooperates with the barrel 14 mounted within the sleeve 12. For this purpose, the barrel is extended in the door by a head 30, for example of square section, on which is fixed by means of a screw 31 a locking cam 32. The locking cam is preferably substantially flat but carries, on one hand, an abutment 34 which projects in the direction toward the heel 18 of the lever 6 and, on the other hand, a boss 36 extending toward the sleeve 12. Around the head 30, the sleeve 12 has two peripheral slots, respectively 37 and 38 (FIG. 2), separated by two projections 39, 40. A coil spring 42 is wound around the head 30 and maintained in position by the projections 39, 40. The end portions 43, 44 of this spring each extend through one of the slots of the sleeve, respectively 37 and 38, and are each extended on one side of the boss 36 of the cam.

Figure 5:
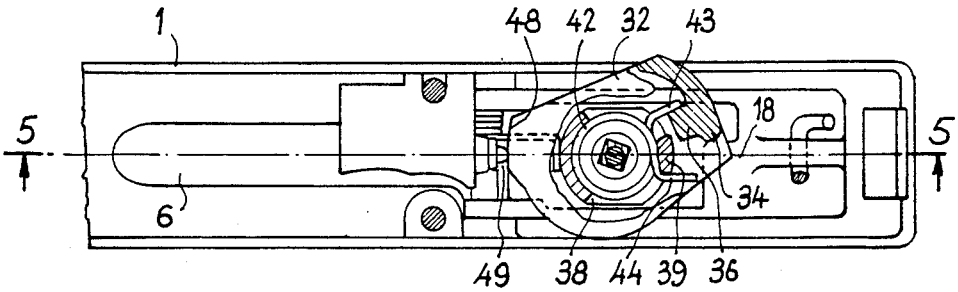
FIG. 5 is a view similar to FIGS. 1 and 3 of the device in the position for effecting the safety opening of the latch.
Figure 6:
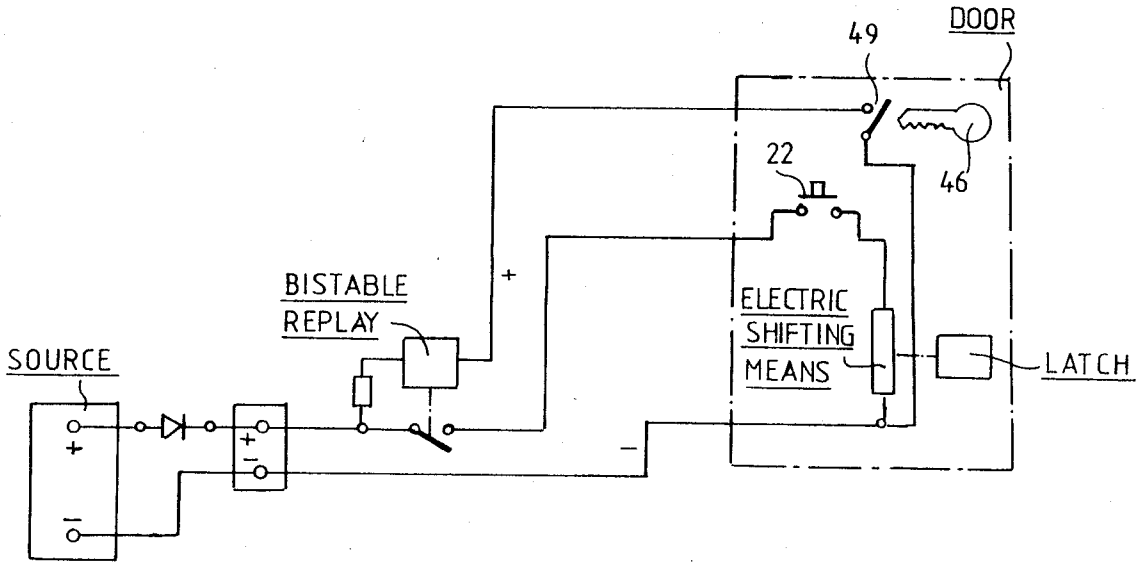
FIG. 6 is a diagram of the control circuitry.

The distance between the end portions 43 and 44 of the spring in the normal position substantially corresponds to the width of the projection 39 of the sleeve and to the width of the boss 36 of the cam, and the spring is slightly stressed. Consequently, when the barrel 14 is rotated by means of a key 46, this barrel drives the cam 32 to the position shown in FIG. 5 and this cam shifts the end portion 43 through the boss 36 so that, as soon as the key ceases its action, the spring 42 automatically returns the cam 32 to its initial position.

Opposite the abutment 34, the cam 32 has another boss 48 which cooperates with a switch 49 for actuating a bistable relay having two operational conditions controlling the general electric supply circuit of the latch. According to the condition of this relay, the action of the boss 48 thus opens the supply circuit and thereby locks the latch or, on the contrary, closes the supply circuit and unlocks the latch. In any case, as soon as this relay has been actuated and the key has been withdrawn from the barrel 14, the spring 42 returns the cam 32 to the position shown in FIG. 2.

When the rotation of the key 46, in the counter-clockwise direction as viewed in FIG. 2, has resulted in the closure of the supply circuit and consequently the unlocking of the latch, the lever 6 may be actuated for shifting the lug 20 and eliminating its pressure on the flexible covering 25 of the switch. The movable part of the switch is then released and this establishes a contact and closes the supply circuit and power is supplied to the electromagnetic latch control means. However, the pivoting of the lever 6 is limited by the contact of the heel 18 on the abutment 34 in the position shown in FIG. 3. At this moment, if the electric circuit operates normally, the latch is opened.

On the other hand, if the rotation of the key in the counter-clockwise direction has resulted in a locking actuation, the pivoting of the lever and the release of the switch 22 thereby closing the electric circuit has no effect on the latch. On the other hand, in any case, the rotation of the cam 32 moves the abutment 34 away from the path of the heel 18 so that if the key, and consequently the cam, are maintained in this position against the action of the spring 42, a new force can be exerted on the lever 6 and can bring it to the position shown in FIG. 5, which raises the heel 18 beyond the position shown in FIG. 3. The linkage 27 is then shifted beyond its lost-motion travel and comes into action for opening the latch.

As soon as the door is opened, the key may be withdrawn. The spring 10 biases the lever 6 to its initial position.

The latch can thus always be opened in a sure manner by means of the key. This key, in the same way as the locking cam, always rotates in the same direction, namely in the counter-clockwise direction as viewed in FIGS. 2 and 4, so that it is always actuated in the same way.

Further, the locking device, constituted by the switch 49 and the bistable relay controlled by the latter, has an extremely small overall size so that it is possible to reduce the volume of the control assembly while providing increased safety.

It will be understood that the control lever 6 may be replaced by a knob or any other like means connected to the lug 20 and the heel 18, depending on the applications.

Having now described my invention what I claim as new and desire to secure by Letters Patent is:

1. An exterior control structure in combination with a vehicle door, a latch for the door, electric shifting means combined with the latch for selectively opening and closing the latch, an electric circuit including switching means for electrically controlling the electric shifting means, a linkage for mechanically opening the latch in the event of breakdown of said electric circuit or electric shifting means, said control structure comprising an actuating element mounted on the door to be movable between a first position and a second position, means for resiliently returning the actuating element to said first position for closing the latch, and a rotatable barrel actuatable by a key and having an inner end, means for locking and preventing operation of the latch and cooperative with said inner end of the barrel, the actuating element having an end which defines a lug cooperative with said switching means of the electric circuit for controlling said electric shifting means for the latch and a heel cooperative with the linkage, the means for locking the latch comprising a locking cam which is fixed to the barrel and carries an abutment cooperative with the heel of the actuating element, said abutment being movable with said cam by said key between a first position in which the abutment lies in a path of movement of the heel and thereby prevents the actuating element from moving to said second position of the actuating element and a second position in which the abutment is clear of said path of movement and allows the actuating element to move to said second position of the actuating element and open the latch by means of said linkage.

2. A control structure according to claim 1, comprising resiliently yieldable means for resiliently biasing the locking cam to said first position of the cam.

3. A control structure according to claim 1, comprising a source of power for the electric circuit, a bistable relay for selectively opening and closing the electric circuit, the cam comprising a lateral boss which is remote from the abutment, a switch of said switching means being cooperative with the bistable relay for actuating the bistable relay, said boss being cooperative with said switch.

4. A control structure according to claim 3, wherein the abutment and the boss are so placed on the cam as to come into action alternately, the rotation of the cam by the key moving the abutment away from the heel of the element when the boss acts on said switch of the relay.

5. A control structure according to claim 1, wherein the linkage is connected to an ear of the heel and includes a lost-motion travel rendering the linkage inoperative during movement of the actuating element between said first and second positions thereof, but operative to open the latch when the actuating element is shifted beyond said second position thereof.

6. A control structure according to claim 1, wherein said switching means comprise a switch, the lug of the actuating element being cooperative with the switch for depressing and opening the switch in said first position of the actuating element corresponding to a closed latch.

* * * * *